US011382823B1

(12) United States Patent
Campbell

(10) Patent No.: US 11,382,823 B1
(45) Date of Patent: Jul. 12, 2022

(54) ROLLER MASSAGE TABLE

(71) Applicant: William Campbell, Aiken, SC (US)

(72) Inventor: William Campbell, Aiken, SC (US)

( * ) Notice: Subject to any disclaimer, the term of this patent is extended or adjusted under 35 U.S.C. 154(b) by 420 days.

(21) Appl. No.: 16/367,981

(22) Filed: Mar. 28, 2019

(51) Int. Cl.
*A61H 15/00* (2006.01)

(52) U.S. Cl.
CPC . *A61H 15/0078* (2013.01); *A61H 2201/0142* (2013.01); *A61H 2203/0443* (2013.01)

(58) Field of Classification Search
CPC ..... A61H 15/0078; A61H 2203/0443; A61H 2201/0142; A61H 15/00; A61H 15/02; A63B 23/04
See application file for complete search history.

(56) References Cited

U.S. PATENT DOCUMENTS 2,641,252 A * 6/1953 Hemming ..... A61H 15/00 601/98
3,640,272 A * 2/1972 Hussey ..... A61H 1/0222 601/99
3,712,254 A * 1/1973 Beamish ..... D05B 35/102 112/470.36
3,812,846 A * 5/1974 Trout ..... A61H 15/0078 601/116
3,877,422 A 4/1975 Heuser et al.
4,065,804 A * 12/1977 Rostad ..... H02H 7/0833 361/96
4,586,493 A * 5/1986 Goodman ..... A61H 1/00 601/116
5,501,658 A * 3/1996 Frye ..... A61H 15/0078 601/84
6,206,166 B1 3/2001 Picou
6,409,689 B1 * 6/2002 Chen ..... A61H 15/0078 601/103
6,849,054 B1 2/2005 Kim
6,890,313 B2 5/2005 Kim
6,960,174 B2 * 11/2005 Fenkel ..... A61H 1/0218 601/102
7,037,279 B2 5/2006 Kim
7,052,475 B2 5/2006 Kim
7,052,476 B2 5/2006 Kim
7,081,098 B2 7/2006 Kim
7,118,541 B2 10/2006 Kim
8,418,298 B2 4/2013 Jones
2002/0193713 A1 * 12/2002 Lee ..... A61H 15/0078 601/99
2006/0100558 A1 * 5/2006 Smith ..... A61H 15/02 601/128
2013/0042413 A1 * 2/2013 Cao ..... A61H 9/0078 5/694
2017/0258671 A1 * 9/2017 Turner ..... A61H 7/008

FOREIGN PATENT DOCUMENTS

WO WO-9966874 A1 * 12/1999 ..... A61H 15/0078

* cited by examiner

*Primary Examiner* — Timothy A Stanis
*Assistant Examiner* — Matthew R Moon
(74) *Attorney, Agent, or Firm* — Cramer Patent & Design, PLLC; Aaron R. Cramer

(57) ABSTRACT

A roller massage table has a leg under each comer, a leg disposed under the center of the table, and a roller mechanism mounted within the center of the table. The roller mechanism includes a spring-loaded wheel and is slidingly mounted to a pair rails on the underside of the table enabling the roller mechanism to move up and down along a single axis.

13 Claims, 5 Drawing Sheets

ROLLER MASSAGE TABLE

FIELD OF THE INVENTION

The present invention relates to a roller massage table.

BACKGROUND OF THE INVENTION

There are a great many people who suffer from back pain that is derived from a number of sources. Relief in the form of a massage is often the preferred remedy for many. Such massages can range from private massages from a masseuse or masseur to medical massages provided by a health care professional. One type of back massage that is favored by many is that obtained from a "Roller Table" which provides for spinal mobilization and pre-adjustment chiropractic operations. These tables provide a deep shiatsu style massage that helps relieve muscle spasms via a rolling wheel that moves back and forth over the patient's back area.

Unfortunately, such tables are expensive and as such, are typically only found in chiropractor's offices. Accordingly, there exists a need for a means by which automated medical grade roller massages can be provided virtually anywhere, including the comfort of one's home in a cost-effective manner. The development of the portable roller massage table fulfills this need.

SUMMARY OF THE INVENTION

It is therefore an object of the present invention to provide a portable roller massage table device comprises a table surface supported by an apron. The table surface is provided with a rectangular opening which will generally align with a spine area of a user when lying upon the table surface with their head at a head placement area in a supine position. The table surface is provided with a padded covering. A massaging effect may be provided by the massage wheel penetrates the padded covering.

The device also comprises a fixed frame which is provided below the table surface and centered about the rectangular opening. The device further comprises a movable frame which is mounted on the fixed frame by use of a plurality of track guides. The track guides ride in a pair of tracks. The movable frame supports a massage wheel which travels back and forth along the rectangular opening in a reciprocating travel path. The movable frame is propelled along the reciprocating travel path by a transit drive chain supported between a drive axle and an idler axle. The drive axle and the idler axle are connected to the fixed frame. The massage wheel is connected to the movable frame by a spring adjustable frame. The massage wheel extends above the table surface. The movable frame travel is limited and reversed with aid of a pair of travel limit switches which operate in a sequential manner to reverse rotation of the DC motor. The spring adjustable frame includes a vertical member connected to a pivot point and the movable frame and a sprocket gear that connects the transit drive chain to the drive axle and the idler axle. The pivot point is structurally supported by a diagonal brace connected to the movable frame. Variable movement afforded the pressure spring accounts for variations in the user's spine, the user's small of the back, and the user's shoulder blade area. An electrical control box powers the portable roller massage table. The electrical control box includes a power switch to control power to the massage wheel stopped along the reciprocating travel path to apply continuous single point pressure and a table underside providing support to the apron and the fixed frame.

The table surface may be provided without the padded covering and may be six feet long and thirty inches wide. The fixed frame may be made of steel shapes. The pair of tracks may include four track guides. The track guides may be cylindrical-shaped or are L-shaped. The massage wheel may be made of material selected from the group consisting of rubber, foam, or other durable material that retains its shape and deform under moderate force.

The drive axle and the idler axle may be connected to the fixed frame by a plurality of bearings. The transit drive chain may be connected to the movable frame via a mechanical connection. The mechanical connection may be a bolt at each of a first pair of points. The mechanical connection may be a clamp at each of a second pair of points. A central support member that extends upward from a connection point of the movable frame and the diagonal brace. The central support member may be braced by a pivoting horizontal member that is connected to the pivot point. The pivoting horizontal member may swing up and down on an axis of the pivot point.

The device may further comprise a pressure spring mechanism that includes a rod and a pressure spring. The rod may be made of aluminum. When power is passed to a 2-coil latching relay which works in conjunction with a pair of travel limit switches to allow for reciprocating travel. The 2-coil latching relay may provide a voltage to a double-pole double-throw relay which sends polarity to a variable speed circuit. The electrical control box may power the portable roller massage table by an alternating current power cord.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
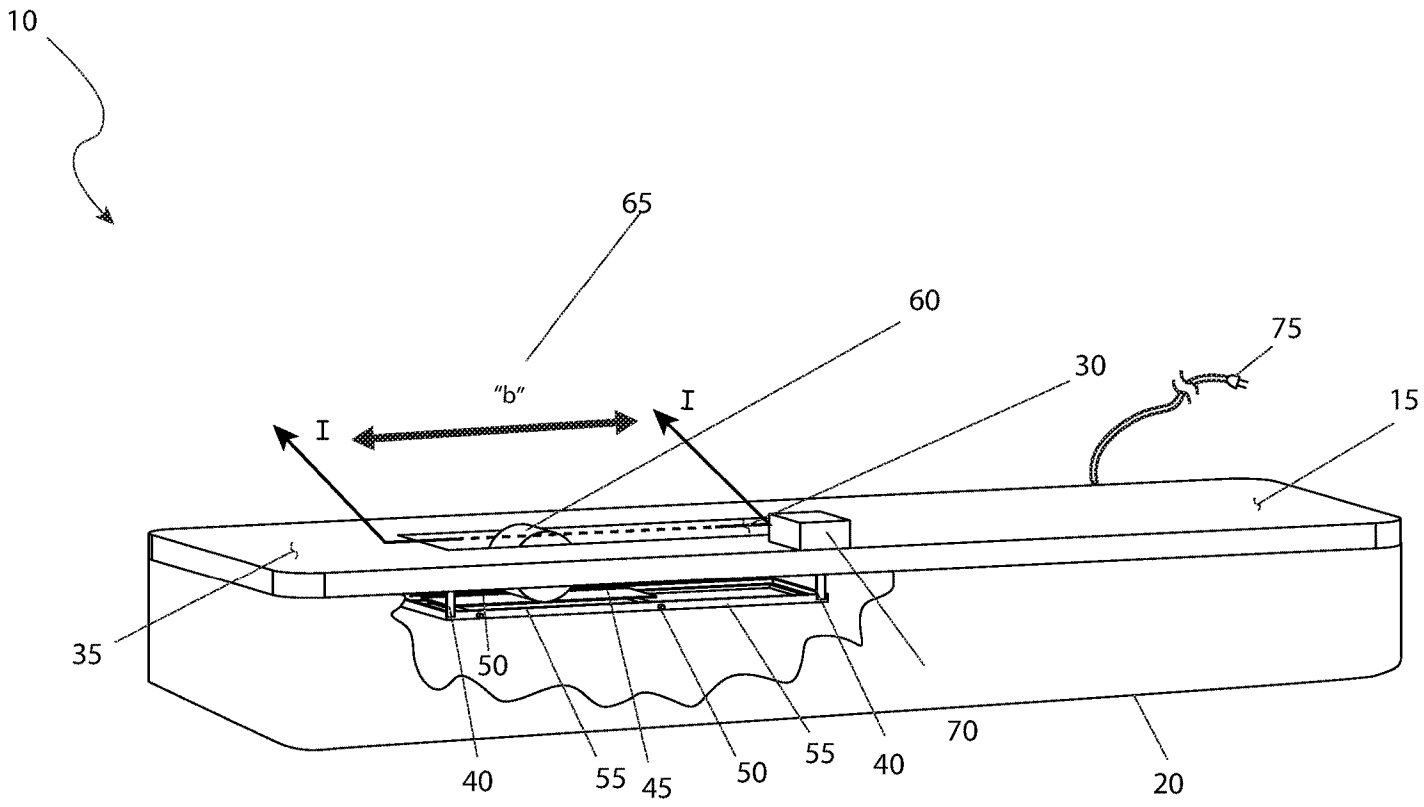
FIG. 1 is a perspective view of the portable roller massage table 10, according to the preferred embodiment of the present invention.

10 portable roller massage table
15 table surface
20 apron
30 rectangular opening
35 head placement area
40 fixed frame
45 movable frame
50 track guide

55 track
60 massage wheel
65 reciprocating travel path "b"
70 electrical control box
75 AC power cord
85 padded covering
90 table underside
95 transit drive chain
100 drive axle
105 idler axle
110 bearing
115 sprocket gear
130 DC motor
135 travel limit switch
140 spring adjustable frame
145 mechanical connection
150 vertical member
155 pivot point
160 diagonal brace
165 central support member
170 pivoting horizontal member
172 pressure spring mechanism
180 pressure spring
185 force exertion path "f"
190 user
195 right hand
200 power switch
205 DC power supply
210 2-coil latching relay
215 double-pole double-throw relay
220 variable speed circuit
225 variable speed control potentiometer

DESCRIPTION OF THE PREFERRED EMBODIMENTS

The best mode for carrying out the invention is presented in terms of its preferred embodiment, herein depicted within FIGS. 1 through 5. However, the invention is not limited to the described embodiment, and a person skilled in the art will appreciate that many other embodiments of the invention are possible without deviating from the basic concept of the invention and that any such work around will also fall under scope of this invention It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

1. DETAILED DESCRIPTION OF THE FIGURES

Referring now to FIG. 1, a perspective view of the portable roller massage table 10, according to the preferred embodiment of the present invention is disclosed. The portable roller massage table 10 (herein also described as the "device") 10, includes a table surface 15 with the approximate dimensions of six feet (6 ft.) long and thirty inches (30 in.) wide. It is supported by an apron 20. The table surface 15 is provided with a rectangular opening 30 which will generally align with the spine area of a user when he or she lies upon the table surface 15 with their head at a head placement area 35 in a supine position. Further information on the use of the device 10 will be provided herein below.

A fixed frame 40, envisioned to be made of steel shapes, is provided below the table surface 15 and centered about the rectangular opening 30. A movable frame 45 is mounted on the fixed frame 40 by use of four (4) track guides 50 of which only two (2) are shown due to illustrative limitations. The track guides can be cylindrical or "L"-shaped. The track guides 50 ride in two (2) tracks 55 (of which only one (1) is shown due to illustrative limitations). The movable frame 45 supports a massage wheel 60 which travels back and forth along the rectangular opening 30 in a reciprocating travel path "b" 65. The massage wheel would be made of rubber, foam, or other durable material that while it retains its shape, will deform under moderate force. The device 10 is powered by an alternating current (AC) power cord 75 and is controlled by an electrical control box 70. It is noted that the table surface 15 may or may not be provided with a padded covering 85 (not shown due to clarity). Should the padded covering 85 be provided, it is envisioned that the massaging effect provided by the massage wheel 60 would penetrate the padded covering 85 and still provide health benefits to the user.

Figure 2:
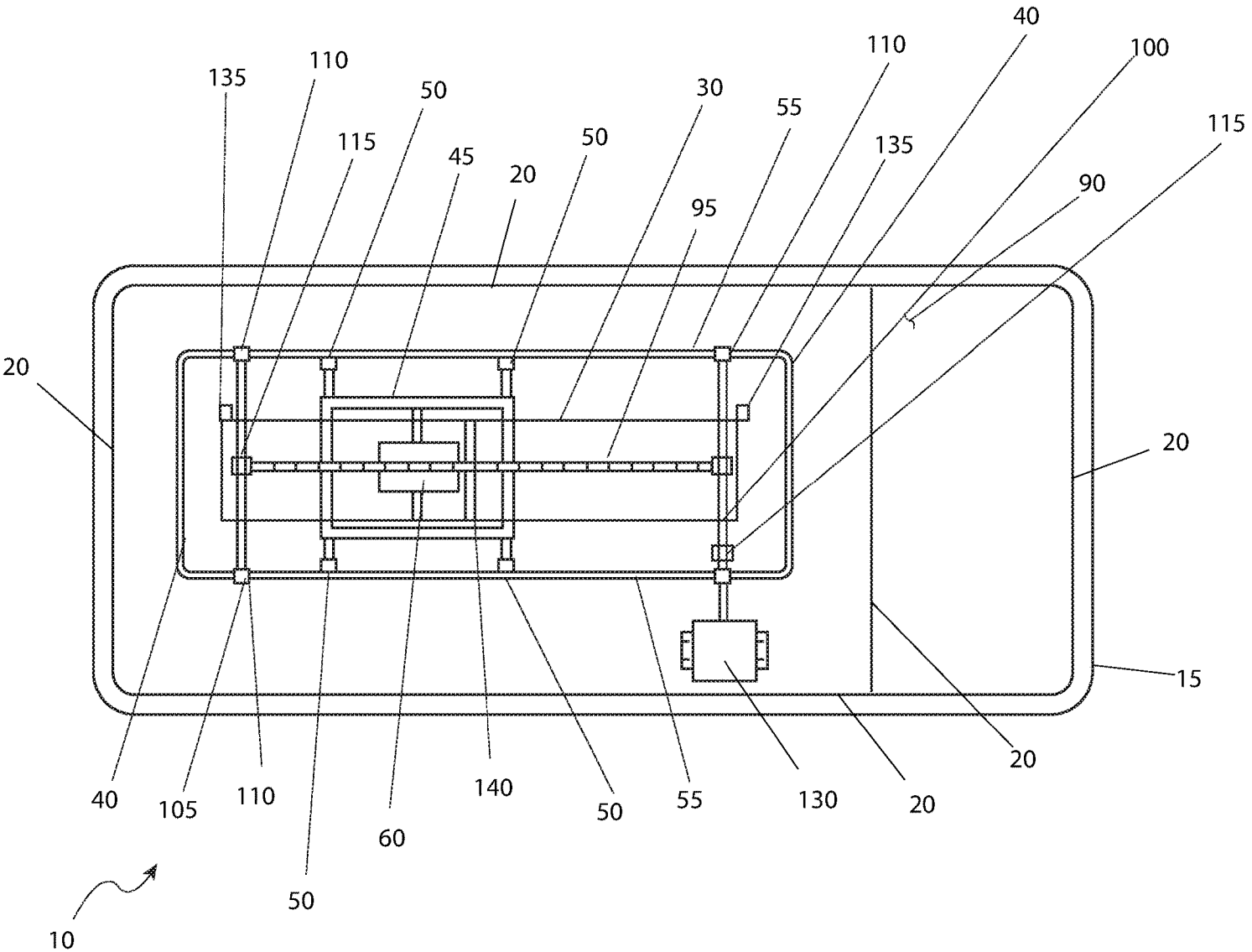
FIG. 2 is a bottom view of the portable roller massage table 10, according to the preferred embodiment of the present invention.

Referring next to FIG. 2, a bottom view of the device 10, according to the preferred embodiment of the present invention is depicted. A table underside 90 is readily visible and provides support to apron 20 as well as hanging support for the fixed frame 40. The attachment of the movable frame 45 to the fixed frame 40 is accomplished by the four (4) track guides 50 residing in the two (2) tracks 55. The movable frame 45 is propelled along the reciprocating travel path "b" 65 (as shown in FIG. 1) by the use of a transit drive chain 95 supported between a drive axle 100 and an idler axle 105. Both the drive axle 100 and the idler axle 105 are connected to the fixed frame 40 by use of two (2) bearings 110 each for a total of four (4). A sprocket gear 115 connects the transit drive chain 95 to the drive axle 100 and the idler axle 105. The drive axle 100 is rotationally driven by a DC motor 130. The travel of the movable frame 45 is limited and reversed with the aid of two (2) travel limit switches 135 which operate in a sequential manner to reverse the rotation of the DC motor 130. Further description on the sequence of operation and use of the travel limit switches 135 and the DC motor 130 will be provided herein below. The massage wheel 60 is connected to the movable frame 45 by a spring adjustable frame 140. The spring adjustable frame 140 will be described in greater detail herein below.

Figure 3:
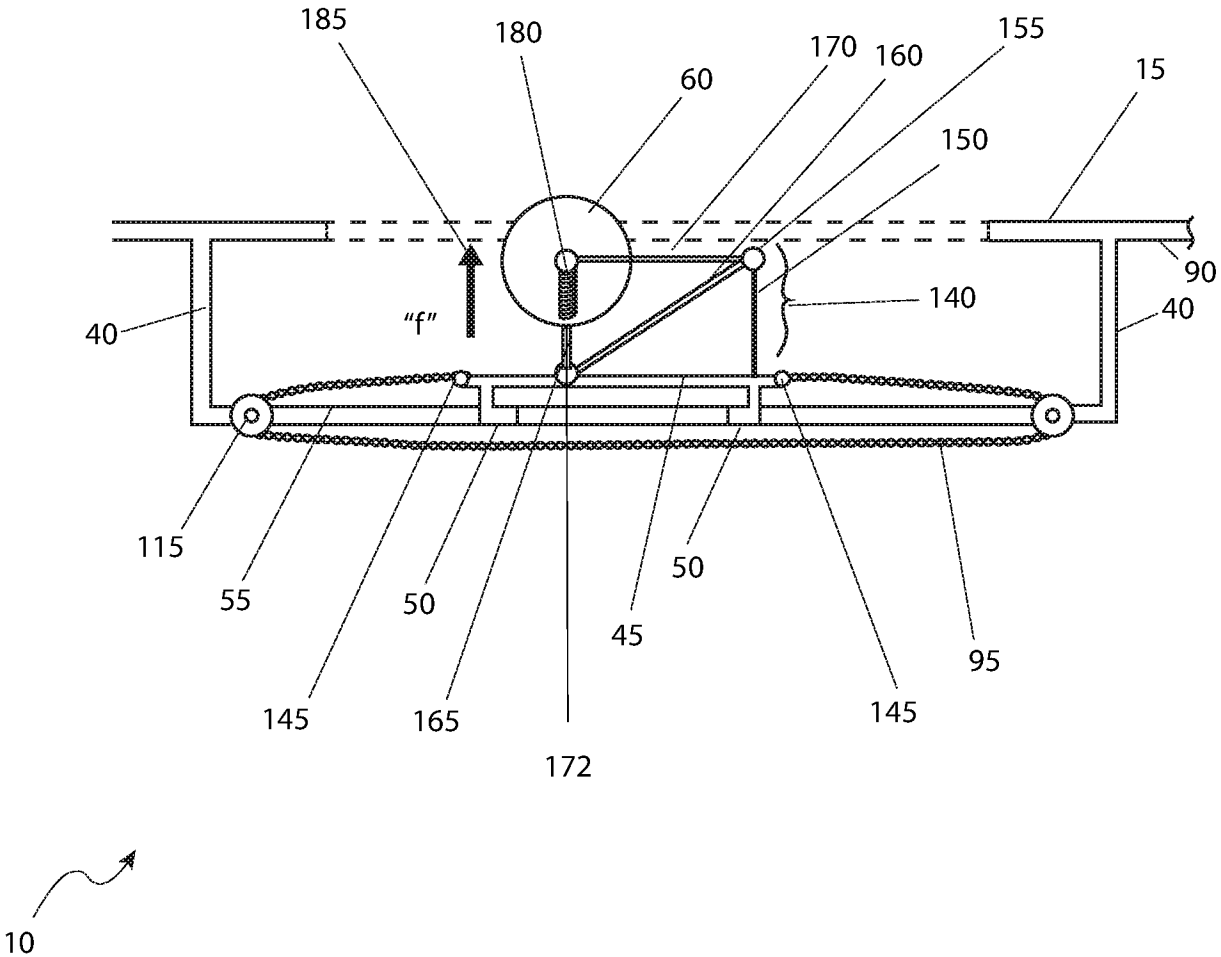
FIG. 3 is a sectional view of the portable roller massage table 10, as seen along a line I-I, as shown in FIG. 1, according to the preferred embodiment of the present invention.

Referring now to FIG. 3, a sectional view of the device 10, as seen along a line I-I, as shown in FIG. 1, according to the preferred embodiment of the present invention is shown. This figure provides further clarification on the reciprocating nature of the massage wheel 60. The tracks 55 are supported by the fixed frame 40 attached to the table underside 90 of the table surface 15. The transit drive chain 95 is connected to the movable frame 45 via a mechanical connection 145 such as a bolt or clamp at two (2) points. The spring adjustable frame 140 includes a vertical member 150 connected to a pivot point 155 and the movable frame 45. The pivot point 155 is structurally supported by a diagonal brace 160 also connected to the movable frame 45. A central support member 165 then extends upward from the connection point of the movable frame 45 and the diagonal brace 160 and is braced by a pivoting horizontal member 170, also connected to the pivot point 155. The pivoting horizontal member 170 swings up and down on the axis of the pivot point 155. A pressure spring mechanism 172 includes an aluminum rod (not shown due to illustrative limitations and a pressure spring 180 Outside ends of the male and female parts are attached to perpendicular aluminum rods (similar to the pivot point 155) and serve to keep springs in place. It is noted that the massage wheel 60 extends above the plane of the table surface 15. The variable movement afforded by the pressure spring 180 accounts for variations in the user's spine such as the small of the back, shoulder blade area, and the like. It is noted that the components described in FIG. 3 are typically one (1) of a set of two (2) with the remaining set not visible due to illustrative requirements.

Figure 4:
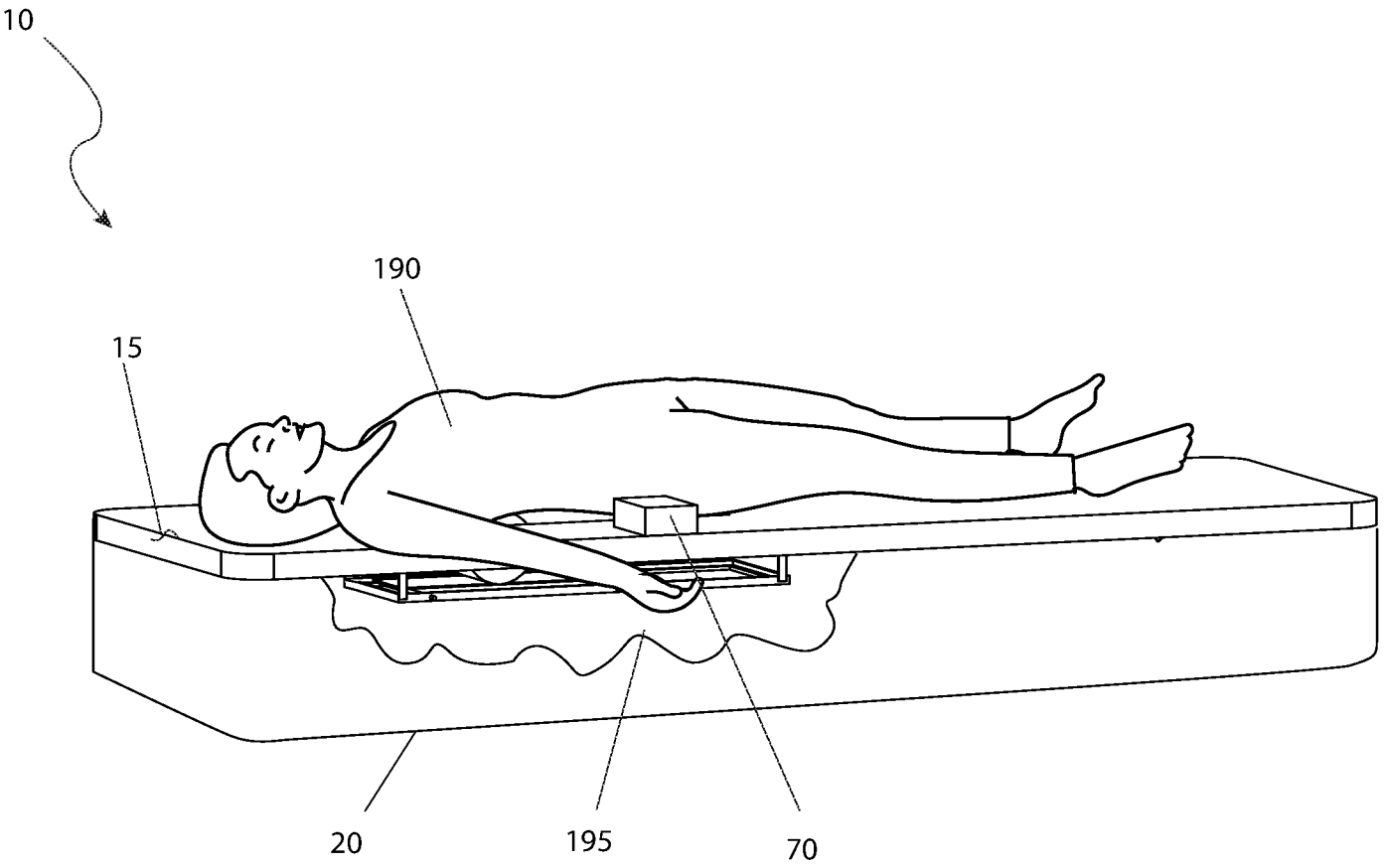
FIG. 4 is a perspective view of the portable roller massage table 10, shown in a utilized state, according to the preferred embodiment of the present invention; and, FIG. 5 is an electrical block diagram of the portable roller massage table 10, according to the preferred embodiment of the present invention.

Referring next to FIG. 4, a perspective view of the device 10, shown in a utilized state, according to the preferred embodiment of the present invention is disclosed. A user 190 is positioned on the table surface 15 in a supine position. It is envisioned that the benefits afforded by the device 10 could be utilized by men and women of all ages. In the suggested position as shown, the electrical control box 70 is near the right hand 195 of the user. The controls afforded by the electrical control box 70 include ON/OFF, allowing the massage wheel 60 (as shown in FIG. 1) to move or be stationary, and the speed at which the massage wheel 60 (as shown in FIG. 1) reciprocates along the reciprocating travel path "b" 65 (as shown in FIG. 1). These treatment sessions are envisioned to last from up to thirty minutes (30 min.), under medical guidance.

Figure 5:
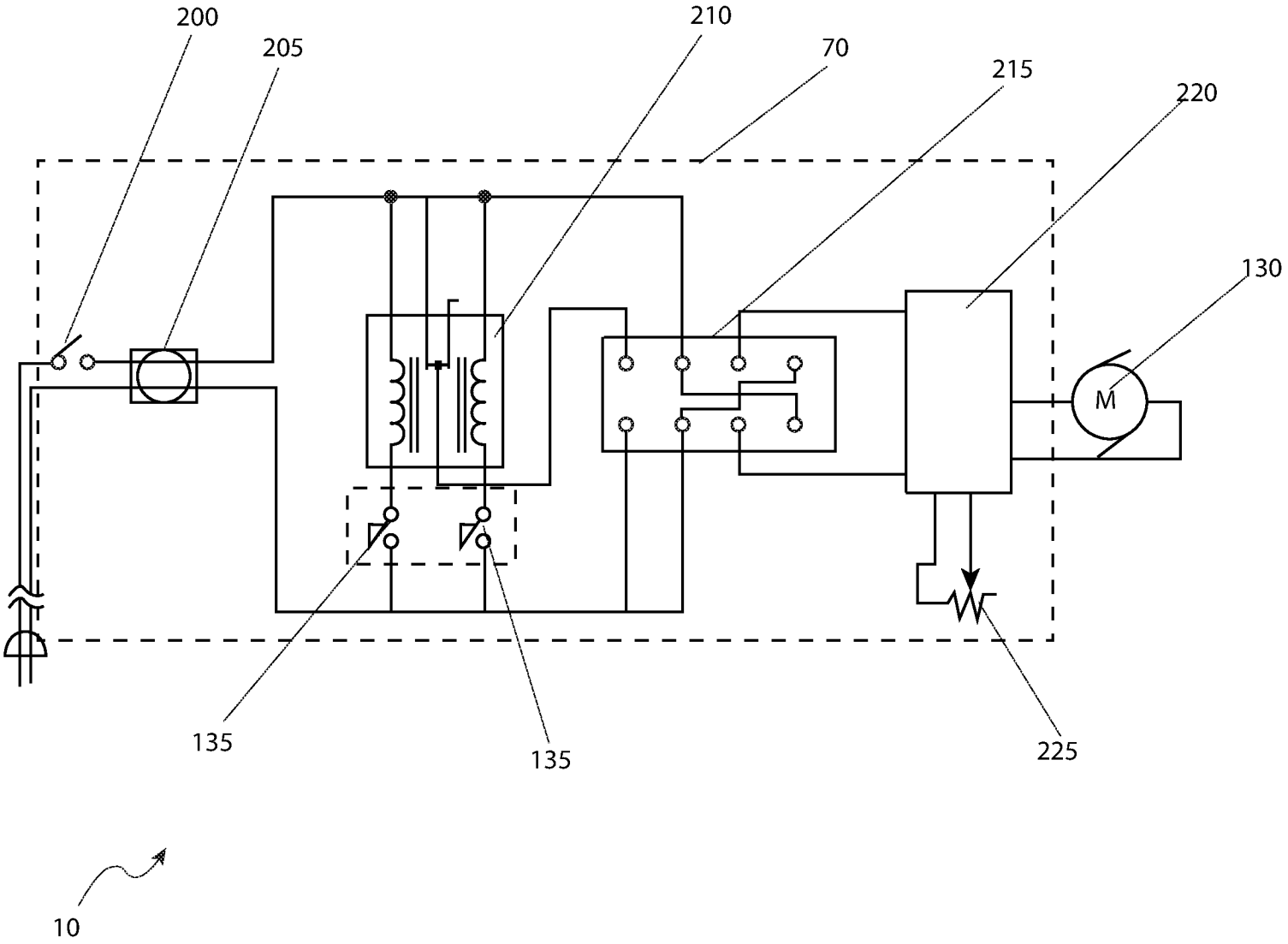

Referring now to FIG. 5, an electrical block diagram of the device 10, according to the preferred embodiment of the present invention is depicted. Incoming AC power is provided by the AC power cord 75. A power switch 200 control the application of power to the device 10 and allows for the massage wheel 60 (as shown in FIG. 1) to be stopped anywhere along the reciprocating travel path "b" 65 (as shown in FIG. 1) to apply continuous single point pressure. A direct current (DC) power supply 205 converts AC to DC to facilitate direction control. The resultant DC power is then passed to a 2-coil latching relay 210 which works in conjunction with the two (2) travel limit switches 135 to allow for reciprocating travel. As controlled by the 2-coil latching relay 210 voltage of the proper polarity is supplied to a double-pole double-throw relay 215 which sends the correct polarity to the variable speed circuit 220. Resultant power from the double-pole double-throw relay 215 is then applied to a variable speed circuit 220 with works with a variable speed control potentiometer 225 (mounted on the outer surface of the electrical control box 70) to supply power to the DC motor 130.

2. OPERATION OF THE PREFERRED EMBODIMENT

The preferred embodiment of the present invention can be utilized by the common user in a simple and effortless manner with little or no training. It is envisioned that the device 10 would be constructed in general accordance with FIG. 1 through FIG. 5. The user 190 would procure the device 10 through normal retail, health appliance or rental organizations. Due to its envisioned low cost, and ability to be easily stored in a minimal amount of space, the device 10 may be purchased outright as well.

After procurement and prior to utilization, the device 10 would be prepared in the following manner: the device 10 would be placed in an upright position in a suitable location; and the AC power cord 75 would be connected to a suitable source of AC power.

During utilization of the device 10, the following procedure would be initiated: the user 190 would lay across the surface of the table surface 15 in general accordance with FIG. 4; the right hand 195 of the user 190 would manipulate the power switch 200 and variable speed control potentiometer 225 on the electrical control box 70 to achieve the desired reciprocating speed of the massage wheel 60 along his or her spinal area. This massaging action would continue as desired by the user 190.

After use of the device 10, it may be left in place until needed again; or stored away by unplugging the AC power cord 75. This usage may continue at a later time as aforementioned described in a circular repetitive manner.

The device 10 is ideal for use in therapy centers, health centers, private doctor's offices, health clubs, and for home use.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. A portable roller massage table, comprising:

a table surface supported by an apron, said table surface is provided with a rectangular opening configured to generally align with a spine area of a user when lying upon said table surface with their head at a head placement area in a supine position, said table surface is provided with a padded covering, wherein a massaging effect provided by a massage wheel penetrates said padded covering;

a fixed frame provided below said table surface and centered about said rectangular opening;

a movable frame mounted on said fixed frame by use of a plurality of track guides, said track guides ride in a pair of tracks, said movable frame supports said massage wheel which travels back and forth along said rectangular opening in a reciprocating travel path, said movable frame is propelled along said reciprocating travel path by a transit drive chain supported between a drive axle and an idler axle, said drive axle and said idler axle are connected to said fixed frame, said massage wheel is connected to said movable frame by a spring adjustable frame, said massage wheel extends above said table surface, said movable frame travel is limited and reversed with aid of a pair of travel limit switches which operate in a sequential manner to reverse rotation of said DC motor, said spring adjustable frame includes a vertical member connected to a pivot point and said movable frame and said idler axle, said pivot point is structurally supported by a diagonal brace connected to said movable frame, wherein variable movement afforded said pressure spring accounts for variations in said user's spine, said user's small of the back, and said user's shoulder blade area;

an electrical control box powering said portable roller massage table, said electrical control box includes a power switch to control power to said massage wheel stopped along said reciprocating travel path to apply continuous single point pressure;

a table underside providing direct support to said apron and said fixed frame; and a central support member that extends upward from a connection point of said movable frame and said diagonal brace;

wherein said transit drive chain is connected to said movable frame via a mechanical connection; and wherein said central support member is braced by a pivoting horizontal member that is directly connected to said pivot point.

2. The portable roller massage table according to claim 1, wherein said table surface is six feet long and thirty inches wide.

3. The portable roller massage table according to claim 1, wherein said fixed frame is made of steel shapes.

4. The portable roller massage table according to claim 1, wherein said track guides include four track guides.

5. The portable roller massage table according to claim 4, wherein said track guides are cylindrical-shaped.

6. The portable roller massage table according to claim 1, wherein said massage wheel is made of material selected from the group consisting of rubber, foam, or other durable material that retains its shape and deform under moderate force.

7. The portable roller massage table according to claim 1, wherein said drive axle and said idler axle are connected to said fixed frame by a plurality of bearings.

8. The portable roller massage table according to claim 1, wherein said mechanical connection is a bolt at each of a first pair of points.

9. The portable roller massage table according to claim 1, wherein said mechanical connection is a clamp at each of a second pair of points.

10. The portable roller massage table according to claim 1, wherein said pivoting horizontal member swings up and down on an axis of said pivot point.

11. The portable roller massage table according to claim 1, wherein power is passed to a 2-coil latching relay which works in conjunction with said pair of travel limit switches to allow for reciprocating travel.

12. The portable roller massage table according to claim 11, wherein said 2-coil latching relay provides voltage to a double-pole double-throw relay which sends polarity to a variable speed circuit.

13. The portable roller massage table according to claim 1, wherein said electrical control box powers said portable roller massage table by an alternating current power cord.

* * * * *